US011066273B2

(12) United States Patent
Fauconnet et al.

(10) Patent No.: US 11,066,273 B2
(45) Date of Patent: Jul. 20, 2021

(54) ELEVATOR OVERTRAVEL TESTING SYSTEMS AND METHODS

(71) Applicant: Otis Elevator Company, Farmington, CT (US)

(72) Inventors: Aurelien Fauconnet, Isdes (FR); Pascal Rebillard, Gien (FR); Gerard Sirigu, Gien (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 730 days.

(21) Appl. No.: 15/915,517

(22) Filed: Mar. 8, 2018

(65) Prior Publication Data

US 2018/0282120 A1 Oct. 4, 2018

(30) Foreign Application Priority Data

Mar. 30, 2017 (EP) ..... 17305368

(51) Int. Cl.
*B66B 1/50* (2006.01)
*B66B 5/28* (2006.01)
(Continued)

(52) U.S. Cl.
CPC ..... *B66B 5/0087* (2013.01); *B66B 1/28* (2013.01); *B66B 1/3492* (2013.01); *B66B 1/48* (2013.01);
(Continued)

(58) Field of Classification Search
USPC ..... 187/247
See application file for complete search history.

(56) References Cited

U.S. PATENT DOCUMENTS 1,980,230 A 11/1934 See
4,102,436 A 7/1978 Kernick et al.
(Continued)

FOREIGN PATENT DOCUMENTS

CN 2570955 9/2003
CN 101195455 6/2008
(Continued)

OTHER PUBLICATIONS

"Article 14. Elevators", NYC Building Codes 1938, [retrieved via internet: https://www1.nyc.gov/assets/buildings/building_code/1938BC_ARTICLE14.pdf on Feb. 16, 2017]; 92 pages.
(Continued)

*Primary Examiner* — Christopher Uhlir
(74) *Attorney, Agent, or Firm* — Cantor Colburn LLP

(57) ABSTRACT

Elevator systems having a first guide rail and a second guide rail, an overtravel feature on at least one of the first or second guide rails, the overtravel feature located a first distance from a top surface of the respective guide rail, an elevator car moveable along the first and second guide rails, the elevator car including a car guidance element, and a control unit configured to perform an overtravel distance test. The control unit is configured to measure a second distance being a distance of travel of the elevator car between a landing position and a location of the overtravel feature, combine the first distance and the second distance to calculate a measured overtravel distance, and compare the measured overtravel distance with a predetermined overtravel setpoint.

18 Claims, 7 Drawing Sheets

(51) Int. Cl.

| | |
|---|---|
| ***B66B 5/00*** | (2006.01) |
| ***B66B 1/48*** | (2006.01) |
| ***B66B 1/28*** | (2006.01) |
| ***B66B 1/34*** | (2006.01) |
| ***B66B 3/00*** | (2006.01) |
| ***B66B 7/02*** | (2006.01) |
| ***B66B 9/00*** | (2006.01) |

(52) U.S. Cl.
CPC ..... *B66B 3/002* (2013.01); *B66B 5/0031* (2013.01); *B66B 5/0093* (2013.01); *B66B 7/022* (2013.01); *B66B 9/00* (2013.01); *B66B 2201/00* (2013.01)

(56) References Cited

U.S. PATENT DOCUMENTS

| | | | |
|---|---|---|---|
| 4,304,319 | A | 12/1981 | Radke |
| 4,418,795 | A | 12/1983 | Trosky et al. |
| 4,768,621 | A | 9/1988 | Kazushi |
| 4,887,695 | A | 12/1989 | Kindler |
| 4,940,117 | A | 7/1990 | Ovaska |
| 8,939,262 | B2 | 1/2015 | Schienda et al. |
| 9,546,074 | B2 * | 1/2017 | Okamoto ..... B66B 5/06 |
| 10,858,218 | B2 * | 12/2020 | Shibata ..... B66B 5/0018 |
| 2015/0039258 | A1 | 2/2015 | Kattaienen et al. |

FOREIGN PATENT DOCUMENTS

| | | | |
|---|---|---|---|
| CN | 202296665 | U | 7/2012 |
| CN | 204938617 | U | 1/2016 |
| CN | 205250760 | | 5/2016 |
| CN | 208327006 | U | 1/2019 |
| EP | 0663367 | | 7/1995 |
| EP | 1497215 | | 1/2005 |
| JP | H05294583 | A | 11/1993 |
| JP | 2000007244 | | 1/2000 |
| WO | 03082722 | A1 | 10/2003 |

OTHER PUBLICATIONS

"Lifts, Escalators and Moving Walks", Bangladesh National Building Code, Chapter 4, vol. 3, 2011; 42 pages.

European Search Report, European Application No. 17305368.7, dated Sep. 27, 2017, European Patent Office; European Search Report 7 pages.

* cited by examiner 301
316
318
314a
314b
303
309
325
320
$D_1$
$D_2$

ELEVATOR OVERTRAVEL TESTING SYSTEMS AND METHODS

CROSS-REFERENCE TO RELATED APPLICATIONS

This application claims the benefit of European Application No. 17305368.7, filed on Mar. 30, 2017, which is incorporated herein by reference in its entirety.

BACKGROUND

The subject matter disclosed herein generally relates to elevator systems and, more particularly, elevator overtravel testing systems and methods.

Elevator systems are installed with overtravel distances located above an elevator car at the top of an elevator shaft. During construction, installation, and maintenance of elevator systems, the overtravel distance is manually measured to ensure compliance with regulations and/or to comply with system design and/or requirements. Accordingly, improved systems for measuring overtravel distances may be advantageous.

SUMMARY

According to some embodiments, elevator systems are provided. The elevator systems include a first guide rail and a second guide rail, an overtravel feature on at least one of the first or second guide rails, the overtravel feature located a first distance from a top surface of the respective guide rail, an elevator car moveable along the first and second guide rails, the elevator car including a car guidance element, and a control unit configured to perform an overtravel distance test. The control unit is configured to measure a second distance being a distance of travel of the elevator car between a landing position and a location of the overtravel feature, combine the first distance and the second distance to calculate a measured overtravel distance, and compare the measured overtravel distance with a predetermined overtravel setpoint.

In addition to one or more of the features described herein, or as an alternative, further embodiments of the elevator systems may include that both the first and second guide rails include respective overtravel features.

In addition to one or more of the features described herein, or as an alternative, further embodiments of the elevator systems may include that the location of the overtravel feature is determined by a lateral movement of the elevator car when the car guidance element interacts with the overtravel feature.

In addition to one or more of the features described herein, or as an alternative, further embodiments of the elevator systems may include that the overtravel feature is one of a groove or a protrusion on the respective guide rail.

In addition to one or more of the features described herein, or as an alternative, further embodiments of the elevator systems may include that the control unit is configured to restrict a speed of the elevator car when the measured overtravel distance is less than the predetermined overtravel setpoint.

In addition to one or more of the features described herein, or as an alternative, further embodiments of the elevator systems may include a car position system configured to measure a position of the elevator car within an elevator shaft.

In addition to one or more of the features described herein, or as an alternative, further embodiments of the elevator systems may include an accelerometer located on the elevator car and in communication with the control unit, the accelerometer configured to detect an interaction of the elevator car with the overtravel feature.

According to some embodiments, methods for operating an elevator system are provided. The methods include measuring a landing position of an elevator car relative to a landing in an elevator shaft, driving the elevator car upward along a guide rail above the landing, the guide rail having an overtravel feature located a first distance from a top surface of the guide rail, measuring a movement of the elevator car as it is driven upward along the guide rail, and detecting an interaction of the elevator car with the overtravel feature to measure a second distance. The second distance is a measured distance of movement of the elevator car from the landing position to the interaction with the overtravel feature. The methods include calculating an overtravel distance based on the first and second distances, comparing the calculated overtravel distance with a predetermined overtravel setpoint, and generating a failure indicator when the calculated overtravel distance is less than the overtravel setpoint.

In addition to one or more of the features described herein, or as an alternative, further embodiments of the methods may include limiting an operational speed of the elevator car when the calculated overtravel distance is less than the overtravel setpoint.

In addition to one or more of the features described herein, or as an alternative, further embodiments of the methods may include that the detection of the interaction is determined by a lateral movement of the elevator car when a car guidance element interacts with the overtravel feature.

In addition to one or more of the features described herein, or as an alternative, further embodiments of the methods may include that the overtravel feature is one of a groove or a protrusion on the guide rail.

Technical effects of embodiments of the present disclosure include automated systems for measuring overtravel distances of elevator systems.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
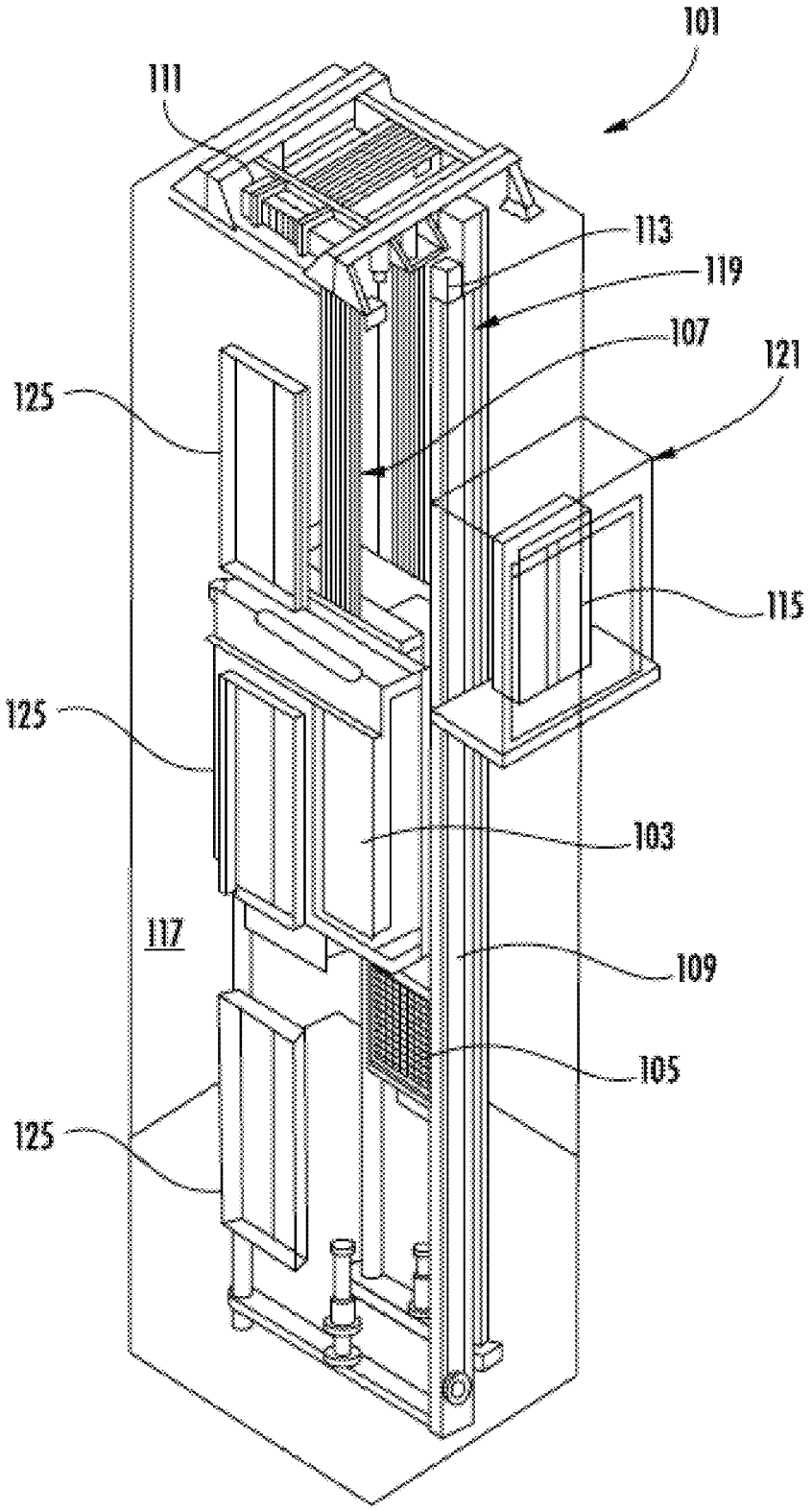
FIG. 1 is a schematic illustration of an elevator system that may employ various embodiments of the present disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "##" that is shown in FIG. X may be labeled "X ##" and a similar feature in FIG. Z may be labeled "Z ##." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1 is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1 is merely a non-limiting example presented for illustrative and explanatory purposes.

During construction, installation, and maintenance of elevator systems, an overtravel distance must be checked during a handover test. Traditionally, such overtravel measurement and testing is manually performed by a mechanic using special tools designed for overtravel measurements. Overtravel is a distance that an elevator car can travel beyond a terminal landing within an elevator shaft (e.g., highest landing within an elevator shaft). Such overtravel is a predetermined, minimum distance that an elevator car can travel as allowance for building inaccuracies, manufacturing and/or installation inaccuracies, building settling, etc.

Figure 2:
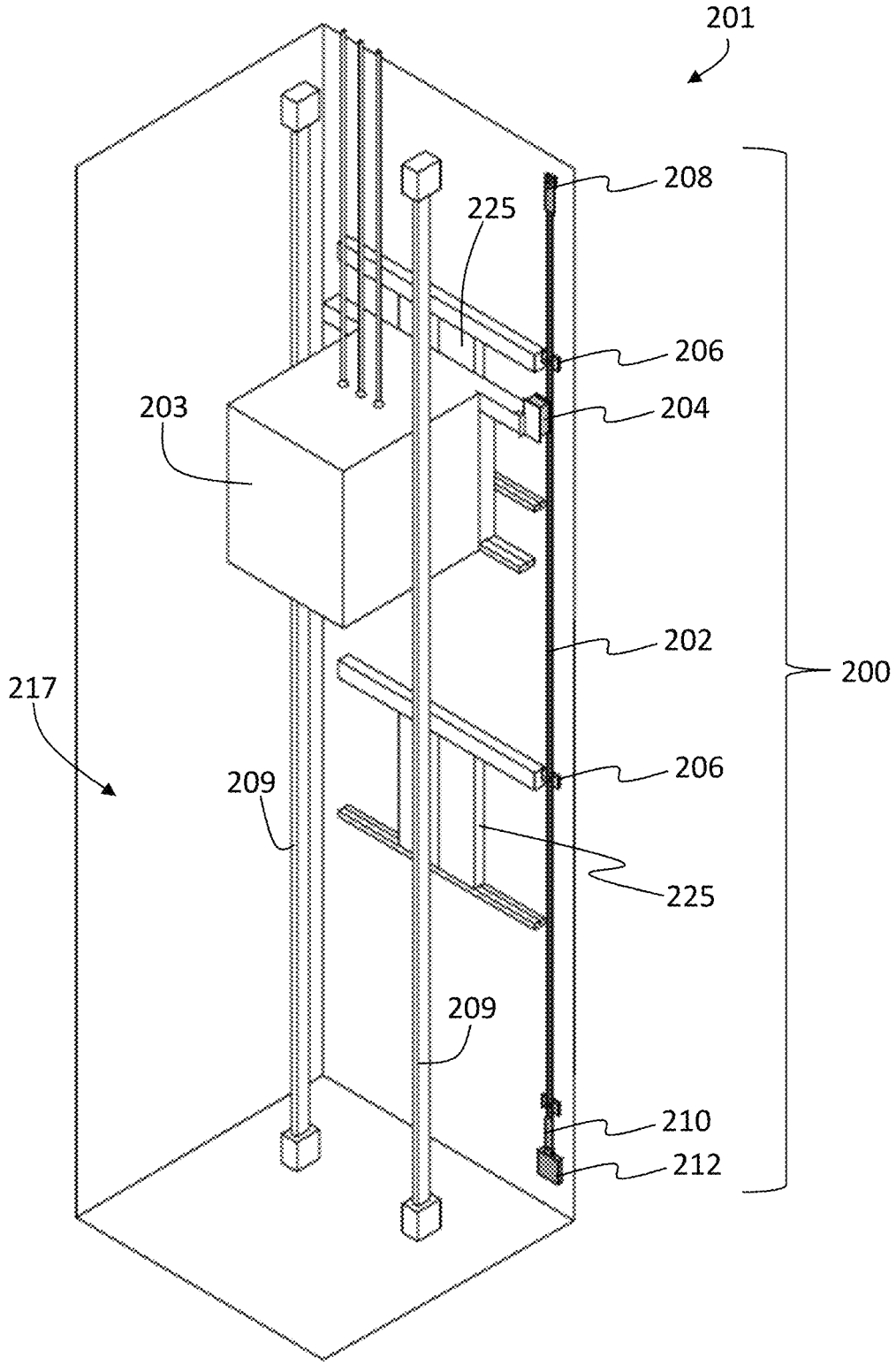
FIG. 2 is a schematic illustration of an elevator car positioning system that may employ various embodiments of the present disclosure.

Turning to now to FIG. 2, a schematic illustration of an elevator system 201 including a car positioning system 200 is shown. The elevator system 201 and/or the car positioning system 200 can incorporate overtravel measurement systems in accordance with embodiments of the present disclosure as described herein. The car positioning system 200 includes a code tape 202 or other similar structure, device, etc. that is used to enable position sensing of an elevator car 203 within an elevator shaft 217. The elevator car 203 moves within the elevator shaft 217 along guide rails 209. The elevator car 203 can be stopped at one or more landings 225 along the elevator shaft 217.

To determine the position of the elevator car 203 within the elevator shaft 217, the elevator car 203 is configured with a car position sensor 204. The car position sensor 204 is mounted or attached to the elevator car 203 and, in example non-limiting embodiments, the car position sensor can be attached to or part of a car door operator and/or lintel, elevator car top, etc. The car position sensor 204 can detect a portion of the code tape 202 to determine a position of the car position sensor 204 along the code tape 202, and thus a position of the elevator car 203 within the elevator shaft 217. Each of the landings 225 are configured with position indicator clips 206. The position indicator clips 206 can be detected by the car position sensor 204 so that the elevator car 203 can be positioned at the associated landing 225 for a stopping operation (e.g., for loading/unloading passengers).

The code tape 202 is mounted to a wall of the elevator shaft 217. A top tension lock 208 supports and retains the code tape 202 at a top of the elevator shaft 217. Similarly, at the bottom of the code tape 202 a bottom tension lock 210 is provided, and a tension weight 212 is also attached to the code tape 202 to apply tension thereto and thus provide an accurate position of code tape 202 along the height of the elevator shaft 217.

Although a precise position of the elevator car 203 within the elevator shaft 217 can be monitored using the car positioning system 200, the overtravel distance may not be accurately determined using such car positioning system 200, e.g., the exact position relative to a top of a guide rail may not be detected. Further, as noted above, measuring the overtravel distance may require a mechanic to manually measure such distances. Accordingly, automated mechanisms for measuring the car overtravel distance may be advantageous.

Figures 3A, 3B, 3C:
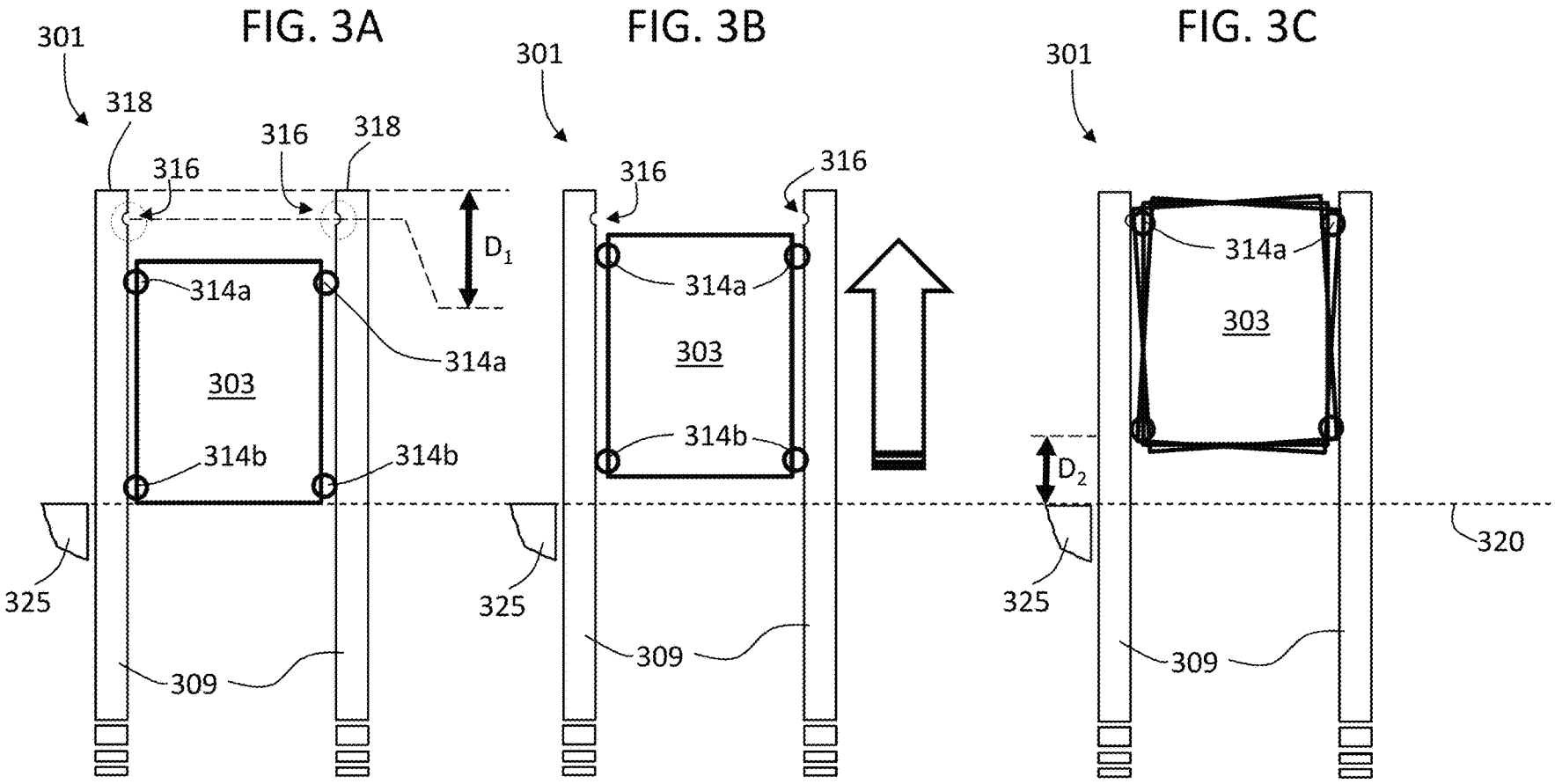
FIG. 3A is a schematic illustration of an elevator system at the beginning of an overtravel distance test in accordance with an embodiment of the present disclosure.
FIG. 3B is a schematic illustration of the elevator system of FIG. 3A showing a transition step of the overtravel distance test.
FIG. 3C is a schematic illustration of the elevator system of FIG. 3A showing a final step of the overtravel distance test.

Turning now to FIGS. 3A-3C, an elevator system 301 having an overtravel distance measurement system in accordance with an embodiment of the present disclosure is shown. The overtravel distance measurement system is provided in addition to a car positioning system such as that shown and described with respect to FIG. 2 and is used to perform an overtravel measurement test for an elevator car 303. The overtravel distance measurement system incorporates structural features incorporated into one or more guide rails 309 of the elevator system 301.

In operation, to perform an overtravel measurement test, the elevator car 303 is moved to a top landing 325 of an elevator shaft along the guide rails 309. The elevator car 303 moves along the guide rails 309 using car guidance elements 314, such as guide shoes, rollers, etc. As shown, the elevator car 303 has a pair of top car guidance elements 314*a* and a pair of bottom car guidance elements 314*b*, located at the top and bottom of the elevator car 303, respectively. At a top portion of one or both of the guide rails 309, one or more overtravel features 316 are positioned at a predetermined position relative to a top surface 318 of the respective guide rail 309. The specific position of the overtravel features 316 is predefined as a specific overtravel distance for the elevator car 303 along the guide rail(s) 309.

The overtravel features 316 can be bumps, protrusions, holes, grooves, or other physical structures or features that extend from or into a surface of the guide rail(s) 309. As shown in FIGS. 3A-3C, the overtravel features 326 are indentations into a blade of the guide rails 309. The overtravel features 326 are designed to enable interaction with the top car guidance elements 314*a* such that a displacement, vibration, side-to-side movement, and/or rocking movement of the elevator car 303 is achieved (as illustratively shown in FIG. 3C).

The overtravel features 316 are positioned at a predetermined first distance $D_1$ from the top surface 318 of the guide rail 309. To begin the overtravel distance measurement test, the elevator car 303 is positioned at a landing level 320 which represents a highest point of elevator car travel during normal operation (i.e., a floor of the elevator car 303 is level with a floor of the landing 325). The elevator car 303 is than moved slowly upward (in a maintenance mode of operation) above the landing level 320. The elevator car 303 is then monitored until the top car guidance elements 314*a* interact with the overtravel features 316 such that a lateral, rocking, or other movement of the elevator car 303 is detected, as shown in FIG. 3C. The lateral, rocking, or other movement of the elevator car 303 can be detected by an accelerometer or other sensor/device, as will be appreciated by those of skill in the art. In other embodiments, when the elevator car 303 reaches the overtravel feature 316, detection of such position can be made through a contact, such as an electrical contact located within or as part of the overtravel feature 316.

As the elevator car 303 is moved upward, a car positioning system, such as that shown and described with respect to FIG. 2, can be used to detect a precise position of the elevator car 303. For example, in an automated overtravel distance measurement test, the elevator car can be conveyed or controlled to move to the top landing 325. The elevator car can be stopped at the top landing and a reference measurement and/or position can be measured or detected (e.g., the landing level 320 can be detected). An elevator controller (e.g., controller 115 of FIG. 1 or other control unit) will start to move the elevator car 303 upward at low speed until interaction with overtravel features 316 is detected (e.g., pitch or rocking of the elevator car 303 as detected by an accelerometer). The control unit can then determine a measured second distance $D_2$ that is a distance traveled by the elevator car 303 from the landing level 320 until the overtravel feature 316 is reached. The second distance $D_2$ can be determined by any known means, including, but not limited to, acceleration integration, machine encoder measurements, and/or car positioning system (e.g., as shown in FIG. 2). The second distance $D_2$ can then be added to the first (predetermined or set) distance $D_1$ to obtain an actual or real world overtravel of the elevator car 303. This measured overtravel distance ($D_1$+$D_2$) can be compared to a pre-set or predetermined overtravel distance (e.g., a factory setting of the elevator system 301).

Figure 4:
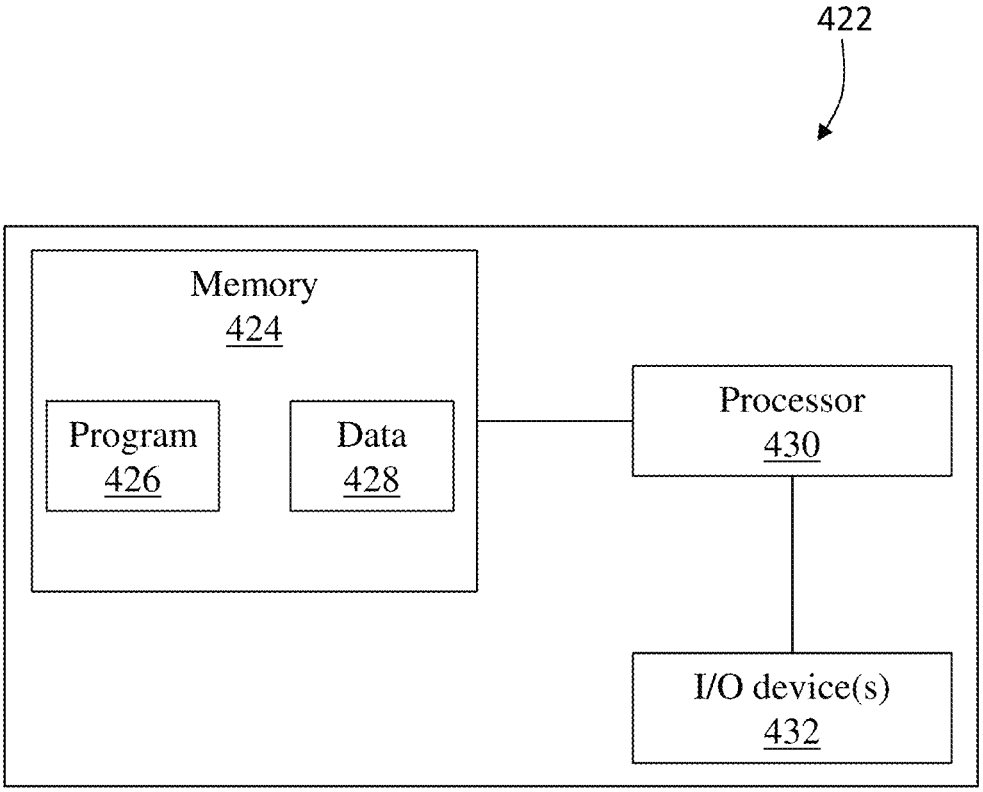
FIG. 4 is a schematic block diagram illustrating a computing system that may be configured for one or more embodiments of the present disclosure.

Referring now to FIG. 4, an example computing system 422 that can be incorporated into elevator systems of the present disclosure is shown. The computing system 422 may be configured as part of and/or in communication with an elevator controller, e.g., controller 115 shown in FIG. 1, and/or as part of an overtravel measurement testing system as described herein. The computing system 422 includes a memory 424 which can store executable instructions and/or data associated with the overtravel measurement testing system. The executable instructions can be stored or organized in any manner and at any level of abstraction, such as in connection with one or more applications, processes, routines, procedures, methods, etc. As an example, at least a portion of the instructions are shown in FIG. 4 as being associated with an overtravel measurement testing program 426.

Further, as shown, the memory 424 can store data 428. The data 428 may include, but is not limited to, elevator car data, elevator modes of operation, commands, or any other type(s) of data as will be appreciated by those of skill in the art. The instructions stored in the memory 424 can be executed by one or more processors, such as a processor 430. The processor 430 may be operative on the data 428.

The processor 430, as shown, is coupled to one or more input/output (I/O) devices 432. In some embodiments, the I/O device(s) 432 may include one or more of a keyboard or keypad, a touchscreen or touch panel, a display screen, a microphone, a speaker, a mouse, a button, a remote control, a joystick, a printer, a telephone or mobile device (e.g., a smartphone), a sensor, etc. The I/O device(s) 432, in some embodiments, include communication components, such as broadband or wireless communication elements. The I/O device(s) 432 can enable a mechanic to initiate a program and/or operation using the computing system 422, such as an overtravel measurement testing operation as described herein.

The components of the computing system 422 may be operably and/or communicably connected by one or more buses. The computing system 422 may further include other features or components as known in the art. For example, the computing system 422 may include one or more transceivers and/or devices configured to transmit and/or receive information or data from sources external to the computing system 422 (e.g., part of the I/O devices 432). For example, in some embodiments, the computing system 422 may be configured to receive information over a network (wired or wireless) or through a cable or wireless connection with one or more devices remote from the computing system 422 (e.g. direct connection to an elevator machine, etc.). The information received over the communication network can be stored in the memory 424 (e.g., as data 428) and/or may be processed and/or employed by one or more programs or applications (e.g., program 426) and/or the processor 430.

Figure 5:
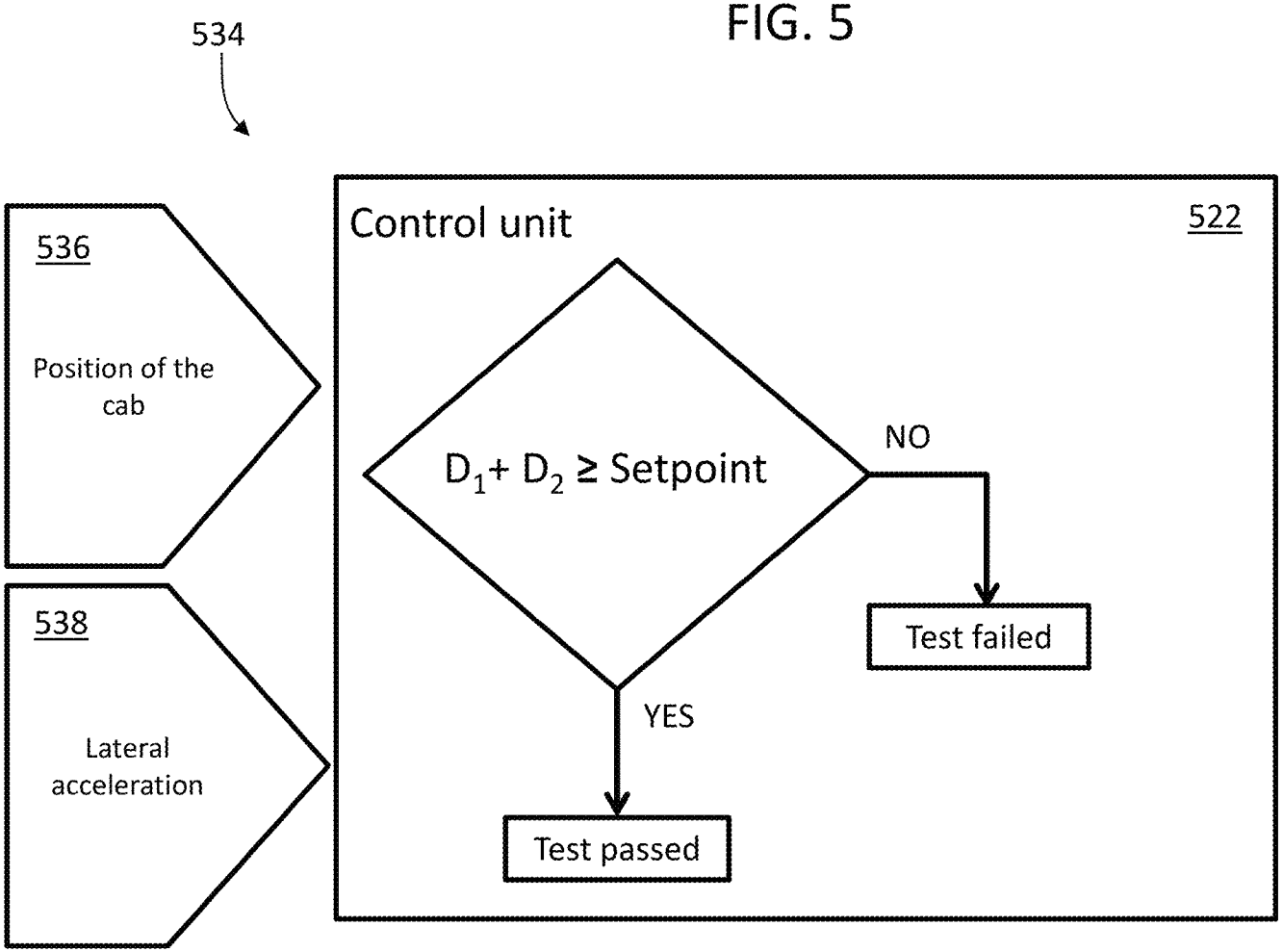
FIG. 5 is a schematic block diagram of an overtravel distance testing system in accordance with an embodiment of the present disclosure.

The computing system 422 is one example of a computing system, controller, and/or control system that is used to execute and/or perform embodiments and/or processes described herein. For example, the computing system 422, when configured as part of an elevator control system, is used to receive commands and/or instructions and is configured to control operation of an elevator car through control of an elevator machine. For example, the computing system 422 can be integrated into or separate from (but in communication therewith) an elevator controller and/or elevator machine and operate as a portion of an overtravel measurement testing system. As used herein, the term "overtravel measurement testing system" refers to one or more components configured to control movement of an elevator car and further detect and measure an overtravel distance of the elevator system. FIG. 5 is a schematic block diagram of an automated overtravel measurement testing system 534 in accordance with an embodiment of the present disclosure. The overtravel measurement testing system 534 includes a control unit 522 that is part of an elevator system. The control unit 522 may be a computing system such as that shown and described with respect to FIG. 4.

The control unit 522 receives as input a position information 536 and a lateral acceleration information 538. The position information 536 can be received from a car positioning system as shown and described above. The lateral acceleration information 538 can be received from an accelerometer that is located on an elevator car that is being tested/measured for overtravel distance. The control unit 522 is also pre-loaded with a predetermined first distance $D_1$ (e.g., as shown in FIG. 3A). The predetermined first distance $D_1$ can be stored within a memory of the control unit 522. As discussed above, the predetermined first distance $D_1$ is a known distance between a top surface of a guide rail and a location of an overtravel feature on the guide rail.

In operation, a mechanic can run an overtravel measurement testing operation that brings the elevator car to the top landing within an elevator shaft. The control unit 522 will automatically control the elevator car to perform the overtravel measurement testing. First, a landing position is measured, then the elevator car is moved upward from the landing and the movement is measured. When the overtravel feature is reached by the elevator car, the elevator car will move in a detectable manner such that reaching the position of the overtravel feature is identified. For example, an accelerometer on the elevator car can detect lateral movement and/or acceleration which is an indication that the overtravel feature is reached. When the elevator car reaches the overtravel feature, the monitoring of the movement of the elevator car is stopped and a distance of travel is calculated. That is, a second distance $D_2$ is calculated based on the movement of the elevator car from the landing to the overtravel feature.

The control unit 522 will then add the first distance $D_1$ and the second distance $D_2$ and compare such result to a predetermined overtravel setpoint. The predetermined overtravel setpoint is a minimum required distance that is set based on requirements of the building, safety regulations, elevator system design, etc. As noted above, the overtravel distance is a predetermined, minimum distance that an elevator car can travel as allowance for building inaccuracies, manufacturing and/or installation inaccuracies, building settling, etc.

As shown, if the addition or summation of the first and second distances $D_1$, $D_2$ is greater than or equal to the setpoint, the test is passed, and if the combination of first and second distances $D_1$, $D_2$ is less than the setpoint, the test is failed. The control unit 522 can output an indication of pass or fail, such that a mechanic can readily determine if the elevator system is in compliance with necessary requirements. If the elevator system passes the overtravel measurement test, the elevator system can be operated in normal operation mode. However, if the elevator system fails the overtravel measurement test, appropriate and/or safety actions can be performed. For example, upon detection of failure of the overtravel measurement test, the elevator system may be run in a low speed operation until appropriate maintenance actions are performed. Further, in some configurations, a message can be generated using an elevator monitoring device and/or controller to be sent to appropriate or predesignated persons/system. In one such example, a message can be sent to a building maintenance terminal for viewing by mechanics, in other embodiments a message can be sent to an offsite maintenance outfit, such as a local agency, company, etc. After the maintenance actions are performed, the overtravel measurement testing can be performed again to test the overtravel distance and ensure the elevator system is in compliance.

Figure 6A:
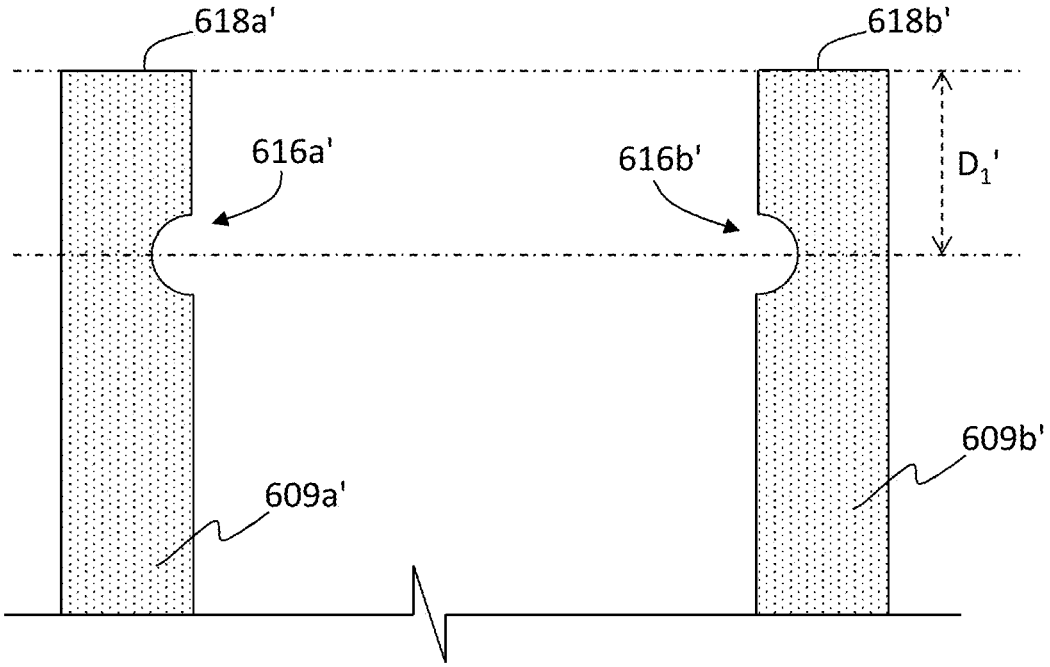
FIG. 6A is a schematic illustration of overtravel features on guide rails in accordance with a non-limiting embodiment of the present disclosure.
Figure 6B:
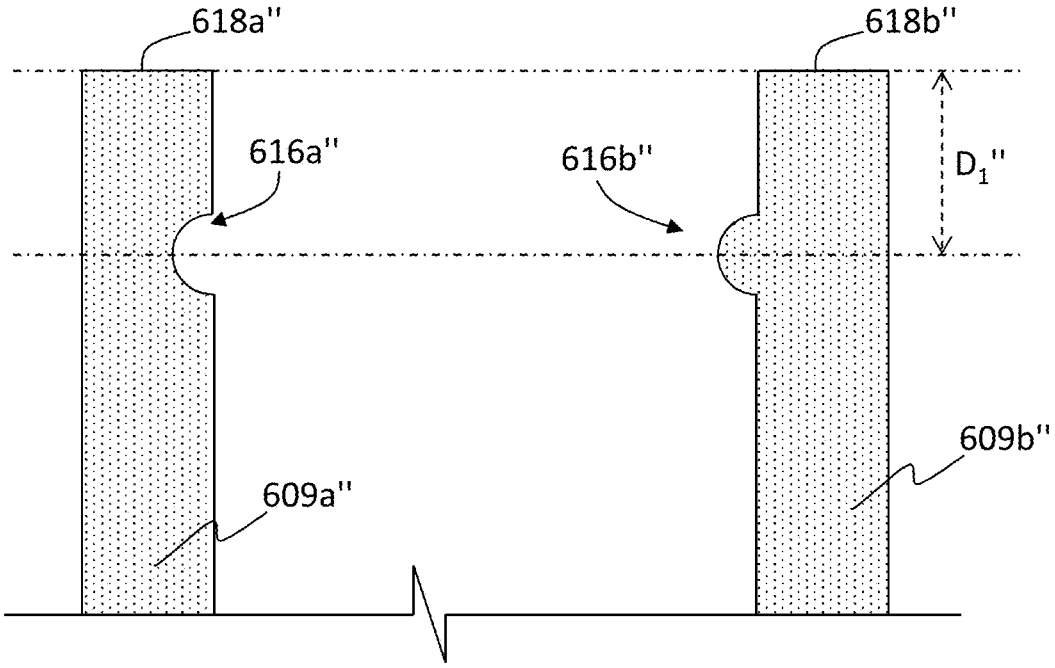
FIG. 6B is a schematic illustration of overtravel features on guide rails in accordance with another non-limiting embodiment of the present disclosure.

Turning now to FIGS. 6A-6B, schematic illustrations of guide rails in accordance with non-limiting embodiments of the present disclosure are shown. FIG. 6A illustrates a first example embodiment of guide rails 609*a*', 609*b*' having respective overtravel features 616*a*', 616*b*'. As shown, the overtravel features 616*a*', 616*b*' are each grooves or indentations that are positioned at a first distance $D_1$' from a top surface 618*a*', 618*b*' of the guide rails 609*a*', 609*b*', respectively. In the embodiment of FIG. 6A, when an elevator car is moved upward along the guide rails 609*a*', 609*b*', the elevator car will shake or vibrate in a lateral direction as car guidance elements interact with the overtravel features 616*a*', 616*b*'. Such movement can be detected by an accelerometer of the elevator car.

FIG. 6B illustrates a second example embodiment of guide rails 609*a*", 609*b*" having respective overtravel features 616*a*", 616*b*". As shown, the overtravel features 616*a*", 616*b*" are different with a first overtravel feature 616*a*" being an indentation or groove in a first guide rail 609*a*" and a second overtravel feature 616*b*" being a bump or protrusion on a second guide rail 609*b*". However, similar to that described above, the first and second overtravel features 616*a*", 616*b*" are positioned at a first distance $D_1$" from a top surface 618*a*", 618*b*" of the guide rails 609*a*", 609*b*", respectively. In the embodiment of FIG. 6B, when an elevator car is moved upward along the guide rails 609*a*", 609*b*", the elevator car will shake or vibrate in a lateral direction as car guidance elements interact with the overtravel features 616*a*", 616*b*". In this particular embodiment, the movement of the elevator car can be urged by the second overtravel feature 616*b*" toward and into the first overtravel feature 616*a*". Such movement can be detected by an accelerometer of the elevator car.

Figure 7:
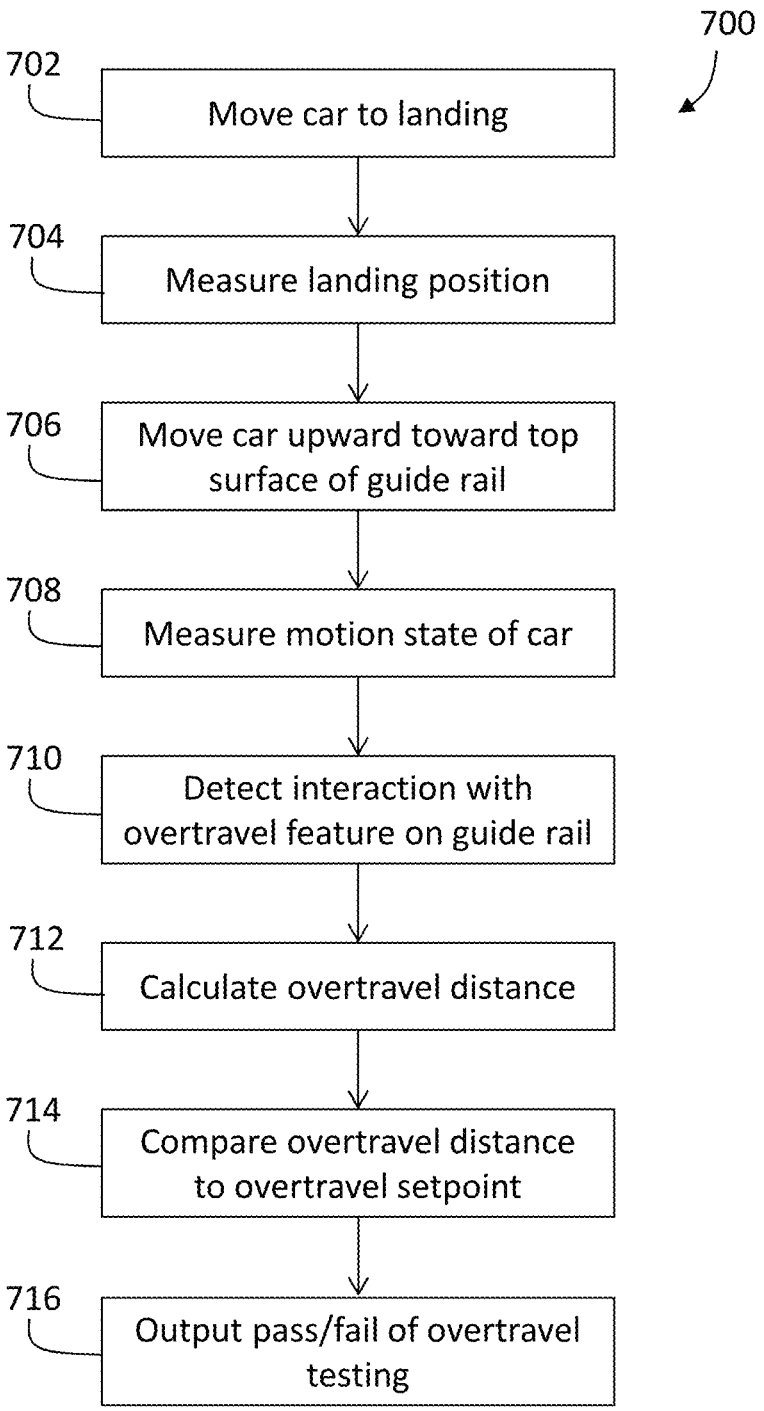
FIG. 7 is a flow process for performing an overtravel distance measurement test in accordance with an embodiment of the present disclosure.

Turning now to FIG. 7, a flow process 700 for performing an automated overtravel distance test is shown. The overtravel distance testing can be performed using an elevator system as shown and described above, having a control unit and an elevator car moveable along one or more guide rails having overtravel features. The overtravel testing can be initiated by a mechanic or other person when it is desirable to measure an overtravel distance of an elevator system. Such testing can be performed when an elevator system is first installed within a building and/or may be performed at various times after installation, such as to monitor the overtravel distance as a building settles over time.

At block 702, the elevator car is moved to the top landing within an elevator shaft. The movement of the elevator car can be controlled by a control unit that is used to put the elevator system in a maintenance mode of operation and initiation of the overtravel testing process may be performed. In some configurations, block 702 can be omitted if the elevator car is already located at the top landing prior to initiation of the flow process 700.

At block 704, the landing position is measured. The measurement of the landing position can be made by a car positioning system. As discussed above, the measurement of the landing position is used to measure a second distance or, stated another way, to measure the starting point of a travel distance to be used in an overtravel measurement.

At block 706, the elevator car is moved upward beyond the top landing and toward a top surface of the guide rails. The elevator car may be driven slowly such that the upward motion of the elevator car is minimal and such that no damage may come to the elevator system. Further, such slow movement may be employed to ensure an accurate detection at block 710, discussed below.

At block 708, as the elevator car is moved upward, the motion state of the elevator car is measured and/or monitored (motion state information or second distance $D_2$). The motion state, as used herein, can be a position, a speed/velocity, and/or acceleration. One or more appropriate sensors can be employed to measure and/or monitor the motion state of the elevator car, including, but not limited to, car positioning systems (e.g., position), elevator machine encoders (e.g., speed), and/or accelerometers (e.g., acceleration).

At block 710, an interaction with an overtravel feature on the guide rail(s) is detected. The detection of the interaction can be obtained from an accelerometer located on the elevator car that detects lateral movement, such as vibrations, shaking, etc. as the car guidance elements interact with the overtravel feature(s) on the guide rail(s). With the detection of the interaction with the overtravel feature(s), the system can stop the elevator car and/or stop monitoring the upward movement of the elevator car.

At block 712, an overtravel distance is calculated. The overtravel distance is calculated from the landing position measured at block 704 and the measured motion state information (e.g., car travel distance, integration of velocity, etc.) obtained at block 708 plus a known distance between the top surface of the guide rail and the location of the overtravel feature(s) (e.g., first distance $D_1$). The measured motion state information is the distance traveled by the elevator car from the landing position to the location of the overtravel feature(s) located on the guide rail.

At block 714, the control unit will compare the calculated overtravel distance from block 712 with an overtravel set-point value. The overtravel set point value is a minimum required distance or space that is required above the elevator car when the elevator car is located at the top landing. The control unit determines if the calculated overtravel distance is greater than or equal to the overtravel set point.

At block 716, the control unit generates an indicator to indicate to a user if the test was passed or if the test failed. If the test failed, the control unit can limit the operation of the elevator system such that a specific elevator speed of travel cannot be exceeded until the test is passed. Upon receiving a failure indication, a mechanic can perform a maintenance operation and then run the flow process 700 again to determine if the maintenance operation corrected the system such that it will pass the overtravel distance measurement test.

Those of skill in the art will appreciate that various example embodiments are shown and described herein, each having certain features in the particular embodiments, but the present disclosure is not thus limited. That is, features of the various embodiments can be exchanged, altered, or otherwise combined in different combinations without departing from the scope of the present disclosure. Further, additional features and/or components can be incorporated into customizable elevator handrails as provided herein without departing from the scope of the present disclosure.

Advantageously, embodiments described herein provide automated elevator testing systems for measuring an overtravel distance. Further, advantageously, time savings may be achieved through the automated overtravel testing provided herein. Moreover, advantageously, the automated nature of embodiments of the present disclosure can allow repeated performance/testing, such that the testing can be performed as frequently as require during the life of the elevator system. Furthermore, because the testing is automated, embodiment provided herein allow the system to perform self-diagnostic (e.g., automatic and/or remotely performed) and thus avoid manual testing.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

Accordingly, the present disclosure is not to be seen as limited by the foregoing description, but is only limited by the scope of the appended claims.

What is claimed is:

1. An elevator system comprising:

a first guide rail and a second guide rail;

an overtravel feature on at least one of the first or second guide rails, the overtravel feature located a first distance from a top surface of the respective guide rail;

an elevator car moveable along the first and second guide rails, the elevator car including a car guidance element; and a control unit configured to perform an overtravel distance test, the control unit configured to:

measure a landing position of the elevator car relative to a landing in an elevator shaft;

drive the elevator car upward along the first and second guide rails above the landing;

measure a second distance, the second distance being a distance of travel of the elevator car between the landing position and a location of the overtravel feature by detecting an interaction of the elevator car with the overtravel feature;

combine the first distance and the second distance to calculate a measured overtravel distance;

compare the measured overtravel distance with a predetermined overtravel setpoint; and generate a failure indicator when the calculated measured overtravel distance is less than the overtravel setpoint.

2. The elevator system of claim 1, wherein both the first and second guide rails include respective overtravel features.

3. The elevator system of claim 1, wherein the location of the overtravel feature is determined by a lateral movement of the elevator car when the car guidance element interacts with the overtravel feature.

4. The elevator system of claim 1, wherein the overtravel feature is one of a groove or a protrusion on the respective guide rail.

5. The elevator system of claim 1, wherein the control unit is configured to restrict a speed of the elevator car when the measured overtravel distance is less than the predetermined overtravel setpoint.

6. The elevator system of claim 1, further comprising a car position system configured to measure a position of the elevator car within an elevator shaft.

7. The elevator system of claim 1, further comprising an accelerometer located on the elevator car and in communication with the control unit, the accelerometer configured to detect an interaction of the elevator car with the overtravel feature.

8. A method for operating an elevator system comprising:

measuring a landing position of an elevator car relative to a landing in an elevator shaft;

driving the elevator car upward along a guide rail above the landing, the guide rail having an overtravel feature located a first distance from a top surface of the guide rail;

measuring a movement of the elevator car as it is driven upward along the guide rail;

detecting an interaction of the elevator car with the overtravel feature to measure a second distance, wherein the second distance is a measured distance of movement of the elevator car from the landing position to the interaction with the overtravel feature;

calculating an overtravel distance based on the first and second distances;

comparing the calculated overtravel distance with a predetermined overtravel setpoint; and generating a failure indicator when the calculated overtravel distance is less than the overtravel setpoint.

9. The method of claim 8, further comprising limiting an operational speed of the elevator car when the calculated overtravel distance is less than the overtravel setpoint.

10. The method of claim 8, wherein the detection of the interaction is determined by a lateral movement of the elevator car when a car guidance element interacts with the overtravel feature.

11. The method of claim 8, wherein the overtravel feature is one of a groove or a protrusion on the guide rail.

12. An elevator system comprising:

a first guide rail and a second guide rail;

an overtravel feature on at least one of the first guide rail or the second guide rail, the overtravel feature located a first distance from a top surface of the respective guide rail;

an elevator car moveable along the first and second guide rails, the elevator car including a car guidance element; and a control unit configured to perform an overtravel distance test, the control unit configured to:

measure a landing position of the elevator car relative to a landing in an elevator shaft;

drive the elevator car upward along the first and second guide rails above the landing;

measure a second distance, the second distance being a distance of travel of the elevator car between the landing position and a location of the overtravel feature by detecting an interaction of the elevator car with the overtravel feature;

add the first distance and the second distance to calculate a measured overtravel distance;

compare the measured overtravel distance with a predetermined overtravel setpoint which is a predetermined minimum distance that the elevator car can travel beyond a terminal landing within an elevator shaft and generate a failure indicator when the calculated measured overtravel distance is less than the overtravel setpoint.

13. The elevator system of claim 12, wherein both the first and second guide rails include respective overtravel features.

14. The elevator system of claim 12, wherein the location of the overtravel feature is determined by a lateral movement of the elevator car when the car guidance element interacts with the overtravel feature.

15. The elevator system of claim 12, wherein the overtravel feature is one of a groove or a protrusion on the respective guide rail.

16. The elevator system of claim 12, wherein the control unit is configured to restrict a speed of the elevator car when the measured overtravel distance is less than the predetermined overtravel setpoint.

17. The elevator system of claim 12, further comprising a car position system configured to measure a position of the elevator car within an elevator shaft.

18. The elevator system of claim 12, further comprising an accelerometer located on the elevator car and in communication with the control unit, the accelerometer configured to detect an interaction of the elevator car with the overtravel feature.

* * * * *